United States Patent [19]

Bubley et al.

[11] 4,184,427

[45] Jan. 22, 1980

[54] MULTI-PURPOSE SCREEN PRINTING MACHINE FOR FLAT OR CURVED SURFACES

[75] Inventors: Henry J. Bubley, Deerfield; Louis A. Lala, Skokie; Hillman W. Taylor, Park Forest, all of Ill.

[73] Assignee: American Screen Printing Equipment Co., Chicago, Ill.

[21] Appl. No.: 827,738

[22] Filed: Aug. 26, 1977

[51] Int. Cl.[2] ..... B41F 15/14; B41F 15/36

[52] U.S. Cl. ..... 101/123; 101/124; 101/38 R

[58] Field of Search ..... 101/123, 124, 126, 127.1, 101/128.1, 35, 38 R, 38 A, 39, 40

[56] References Cited

U.S. PATENT DOCUMENTS

| | | | |
|---|---|---|---|
| 3,090,300 | 5/1963 | Dubuit | 101/123 |
| 3,838,639 | 10/1974 | Harwell et al. | 101/123 |
| 4,079,671 | 3/1978 | Dubuit | 101/124 |
| 4,111,118 | 9/1978 | Green et al. | 101/123 |

FOREIGN PATENT DOCUMENTS

| | | | |
|---|---|---|---|
| 7103979 | 9/1972 | Netherlands | 101/123 |

*Primary Examiner*—Clifford D. Crowder
*Attorney, Agent, or Firm*—Robert E. Wagner; Gerald T. Shekleton

[57] ABSTRACT

An improved low cost screen printing apparatus for printing on both flat and curvilinear objects. Two vertically aligned shafts support the printing head and, by following the pivotal motion of a rocker arm, raise and lower the printing head relative to the object being printed with a straight vertical displacement, resulting from the controlled movement of the upper shaft by the rocker arm which drives the upper shaft through an elongated slot. The squeegee assembly operates in a timed relationship with the raising and lowering of the screen head to alternatively raise and lower the squeegee assembly concurrently with the raising and lowering of the screen so that the squeegee and flood bar are retained in an operative position and parallel to the screen surface during both print and flood cycles. When the screen and squeegee assembly are in the raised position, the squeegee assembly and screen frame are selectively connectable to a reciprocating carriage, for printing either curvilinear or flat objects.

4 Claims, 8 Drawing Figures

MULTI-PURPOSE SCREEN PRINTING MACHINE FOR FLAT OR CURVED SURFACES

BACKGROUND OF THE INVENTION

This invention relates to printing equipment in general and, more specifically, is addressed to a new and improved screen printing machine which is readily adapted to print on objects of various shapes.

Stencil screen printing in the past was known as silk screen printing because of the use of silk as the material for the stencil screen. Even though modern fabrics made the use of silk obsolete, stencil screen printing is still sometimes referred to as silk screen printing. The technology is relatively simple: A printing fluid, such as ink, is transferred to the surface to be printed by means of a squeegee, which forces the ink through a stencil screen having certain areas open, with other areas blocked off, thereby forming the desired design. A wide variety of objects may be printed with the screen printing technique, such as clock dials; ash trays; irregular objects such as plates, cups and coffee pots; and flatwork such as glass and glass thermometers, to mention a few. The applications of screen printing are widespread and continue to increase each year.

Where several different colors are printed, registration of the object to be printed and repeatability of the print is essential for a high-quality multi-color product. In printing flatwork, the screen is held stationary and the squeegee moves across the screen to force the ink through the screen onto the object to define the chosen pattern. Obviously, in this application it is desirable to have the object to be printed in rigid attachment and bring the screen and squeegee to the work. In the printing of irregular objects, such as conical, curvilinear, or cylindrical objects, the squeegee remains stationary and continually biased on the screen, which screen moves simultaneously and at the same linear rate as the circumferential speed of the object to be printed. As before, the squeegee forces the ink through selected areas on the screen to form on the irregular object. One example of such type of printing is a cylindrical pail or drum bearing a message or design. Also, many types of household containers formed of plastic by the blow-molding process carry messages and designs. All of the above flat and irregular objects may be imprinted on a machine of the type described herein.

THE PRIOR ART

One known type of screen printing machine is that described in U.S. Pat. No. 3,090,300, issued May 21, 1963, which machine has been very popular and commercially successful since its introduction. Notwithstanding the commercial success of the machine shown and described in the above patent, many disadvantages exist, chiefly in the area of a relatively high cost to manufacture, which cost is directly related to its design. Moreover, the design characteristics of the prior art are such that the end supports and parts for such a printing machine are required to be made of extremely heavy weight materials, adding to its cost and undesirability insofar as shipping, set-up, movement and handling are concerned.

GENERAL DESCRIPTION OF THE INVENTION

The present invention relates to an improved screen printing machine which permits the object to be printed to be held rigid and the screen and squeegee raised and lowered onto the work. The screen printing machine includes a pair of spaced end supports adapted for mounting on a suitable base or the like. Journaled in the end supports is a first shaft extending between the supports and mounted for rotational movement. Keyed to the first shaft is a pair of arms, which, at their forward ends, support a second shaft in an idler roller guide connection. The second shaft is joined by a pair of links near its ends to a third shaft, which is positioned in vertical alignment below the second shaft. The ends of the second shaft extend through the links and are secured to a rod which is captivated by rollers, which allow the rod to travel in a straight vertical path formed in the end supports by the rollers when the arms are pivoted about the first shaft.

Carried on the second and third shafts are screen support arms which have a means at their lower end for attachment to the screen frame, holder or the like. Also carried on the second and third shafts for reciprocating movement is a squeegee assembly, which supports the squeegee for movement over the stencil screen. Each of the squeegee assembly and screen supports is provided with means permitting it to be selectively attached to a drive assembly having a carriage mounted for reciprocation on the first or lower rear shaft. The drive carriage reciprocates along a fourth shaft beneath the first shaft and has a guide roller which travels in a track extending between the end supports on the base. The drive carriage may be provided with a rack, which cooperates with a pinion for rotating cylindrical, irregular or curvilinear work, thereby enabling the work to be moved at the same rate as the screen during the printing process.

The squeegee assembly includes a squeegee and flood bar, which are alternately raised and lowered in cooperation with the raising and lowering of the screen assembly. The entire squeegee assembly is adapted to be easily removed to a convenient storage position whenever screen or squeegee maintenance becomes necessary.

The new and improved printing machine provides considerable advantages in the manufacture and operation of the machine because of the reduced number of parts and simplicity of design. This, of course, contributes to the reduced costs of manufacture and maintenance, and enlarges the number of applications of the machine.

It is, therefore, an object of this invention to provide a new and improved screen printing machine which is convertible from printing on flat objects to printing on irregular or curvilinear objects.

It is a further object of this invention to provide a new and improved screen printing machine of simplified design which is adaptable to a wide vareity of uses.

It is a still further object of this invention to provide a screen printing machine in which the screen will be maintained in a substantially horizontal condition during both printing and flood cycles, thereby promoting greater uniformity and ink distribution during the printing operation.

It is another object of this invention to provide a new and improved screen printing machine which permits use of a variety of simplified drive arrangements and is readily adaptable to printing on a wide variety of shapes.

It is a still further object of this invention to provide a machine which will be easily tooled and operate in a smooth and consistent manner with excellent registration capability.

It is yet another object of this invention to allow easy maintenance and replacement of the screen and squeegee blades.

DESCRIPTION OF THE DRAWINGS

Further objects of the invention, together with additional features contributing thereto and advantages accruing therefrom, will be apparent from the following description of one embodiment of the invention when read in conjunction with these accompanying drawings, wherein:

Referring now to FIG. 1, the improved screen printing machine is indicated by reference numeral 10 and includes a base of any suitable design, such as that shown at 110, on which is placed the upper cabinet 111. The upper cabinet 111 houses the screen printing head, which is shown in elevation and top plan in FIGS. 2 and 3, with the cabinet omitted.

A tooling post 112 extends from the cabinet 110 and supports a jig or fixture (not shown) on which the material which is to be printed may be supported. As shown in FIGS. 2 and 3, the printing head includes a pair of end supports 13 and 15, formed of any suitable material such as cast iron or the like. Each of the end supports rest on any suitable base, which may be the top 14 of the upper cabinet 111. The end supports 13 and 15 are secured to the top 14 by any desired form of fastening, such as bolts or the like.

Figure 3:
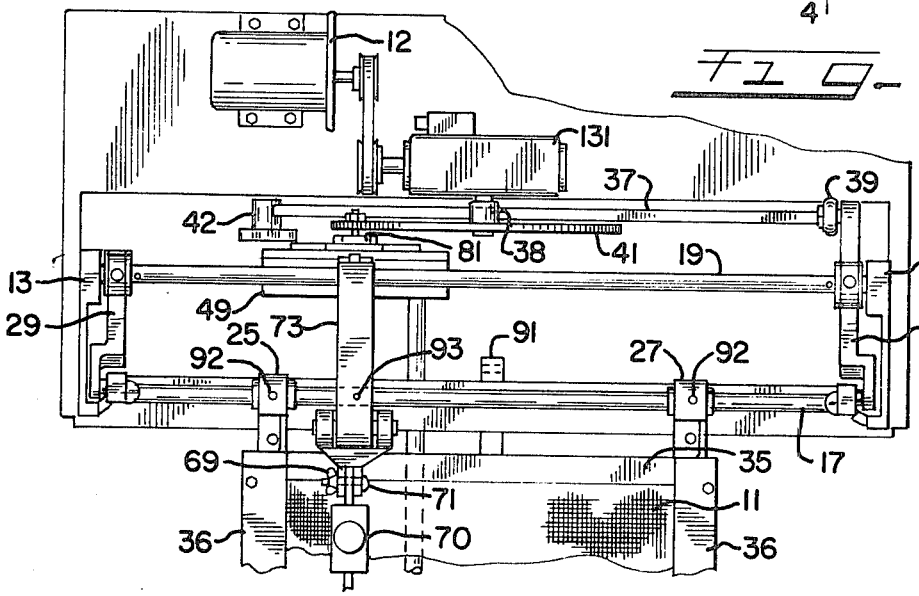
FIG. 3 is a top view of the improved screen printing machine of FIG. 2.
Figure 5:
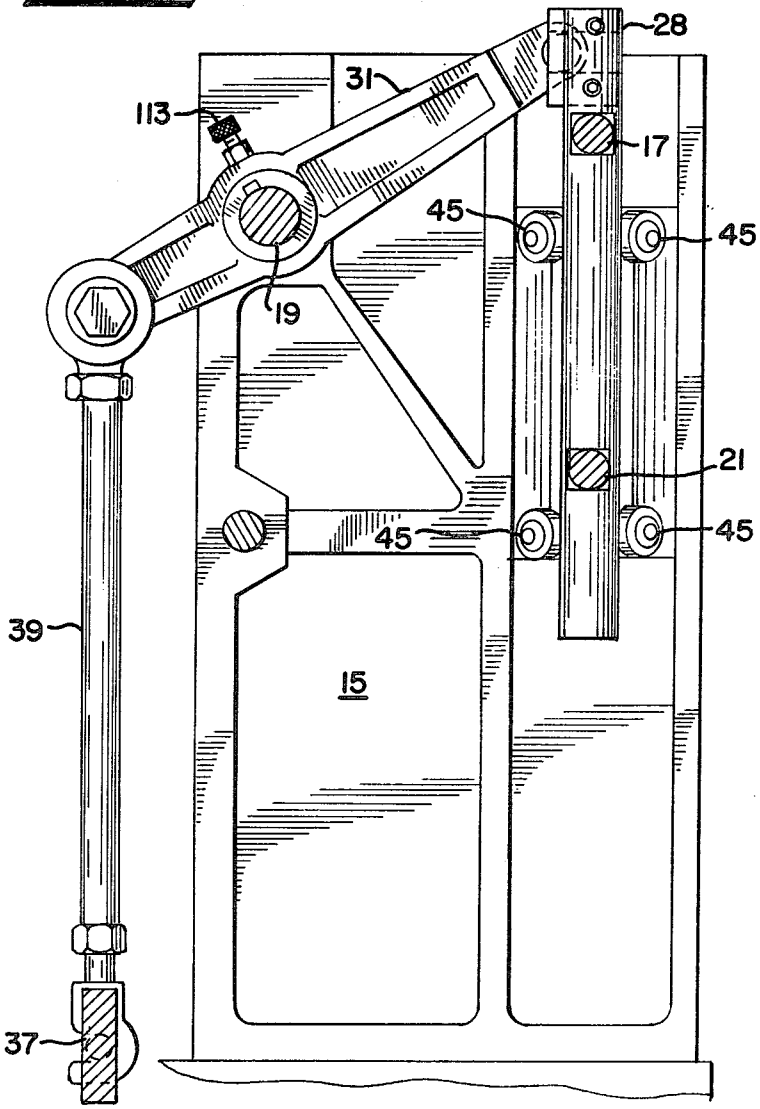
FIG. 5 is a cross-sectional view similar to FIG. 4 of the improved screen printing machine showing the screen in the raised and elevated position.

The printing head includes a first or upper horizontal shaft 19, which is best seen in FIG. 3, which shaft 19 is mounted or journaled for pivoting or oscillating movement in bearings carried in the end supports 13 and 15. Connected to the shaft at either end are rocker arms 29 and 31, which are attached to the shaft by a bolt 113 (FIGS. 4 and 5) and oscillate with it as the shaft 19 pivots.

Figure 7:
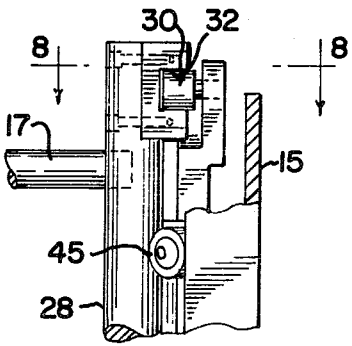
FIG. 7 is an enlarged view taken of an upper idler roller guide connection of the rocker arm with the screen support shafts.
Figure 8:
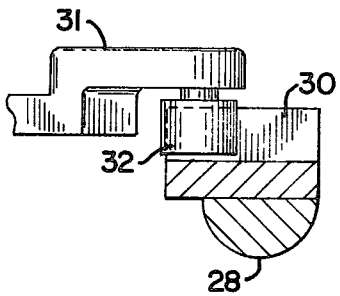
FIG. 8 is a cross-sectional view taken along the line 8—8 of FIG. 7 showing the path of travel of the idler roller.

The arms 29 and 31 support at their front or outer ends a second horizontal shaft 17 through rollers 32 traveling in pathway or slot 30 to form idler guide slots at the upper end of linkage rods 26 and 28 (FIGS. 7 and 8). Also attached at either end to the upper end of the linkage rods, opposite the idler guide slots is the second shaft, thereby retained in parallel with the upper shaft 19. At the lower end of the linkage rods 26 and 28 is attached a third horizontal shaft 21 in a similar manner. Linkage rods 26 and 28 travel in a straight vertical path, guided by two pairs of rollers 45, (FIGS. 4 and 5) mounted on each end support 13 and 15 for smooth movement. Even though the ends of the rocker arms 29 and 31 move in an arcuate path, the linkage rods 26 and 28 can move substantially vertically as a result of the limited movement of rollers 32 in pathway 30 of the idler guide slot connection.

The rollers 45 are adjustable in position relative to one another. Thus, after a continued period of use, should wear occur in the linkage rods 26 and 28, thereby causing sloppy and inexact travel of the shafts 17 and 21 and the attached screen support, the rollers may be adjusted to compensate for this wear and assure a straight, precise lift of the screen at all times and accurate registration of the screen on the workpiece.

Figure 2:
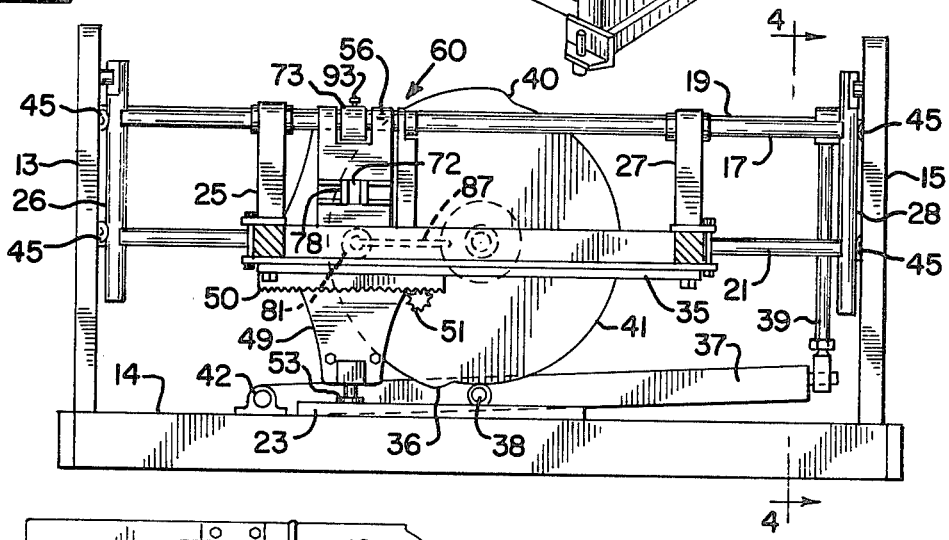
FIG. 2 is a front elevational view of the improved screen printing machine of FIG. 1 with the cabinet and screen and squeegee assembly omitted.
Figure 4:
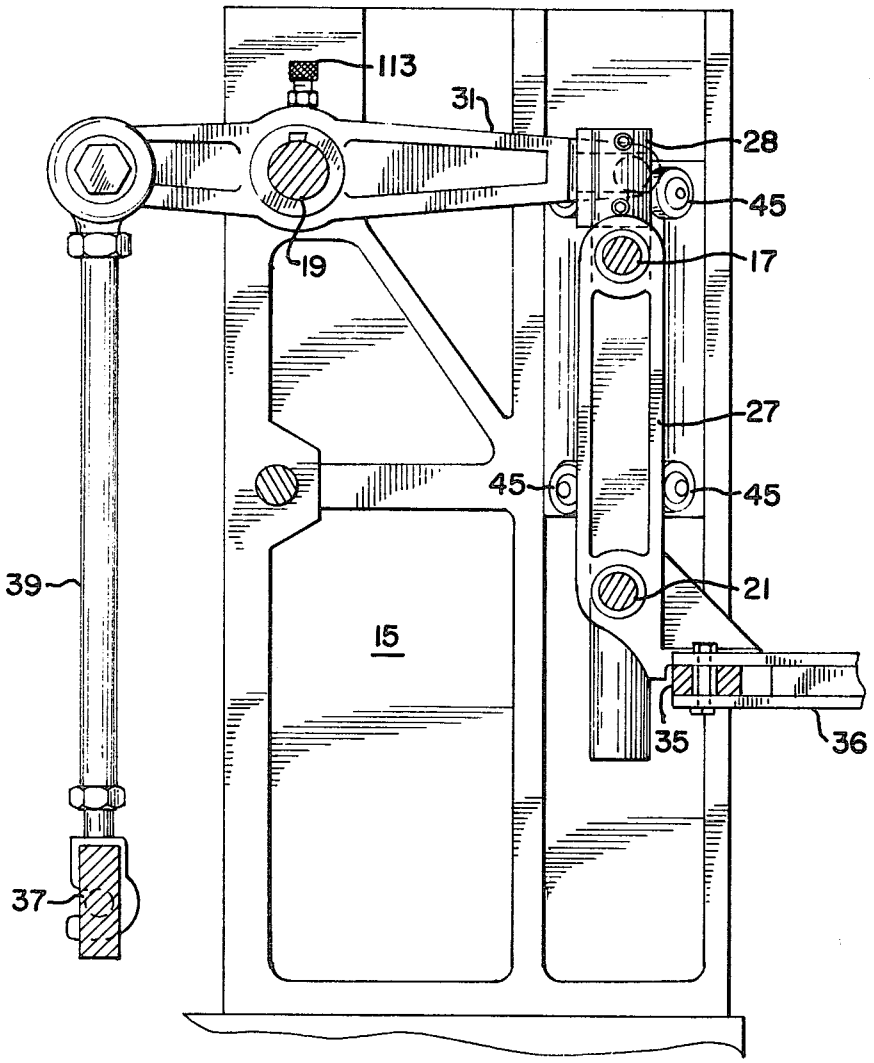
FIG. 4 is a cross-sectional view taken along line 4—4 of FIG. 2, showing the printing position of the screen support means.

As illustrated in FIGS. 2, 3 and 4, the rocker arm 31 extends rearwardly of the shaft 19 and is joined at its rear end to one end of a connecting rod 39. The opposite end of the rod 39 is joined to a lever arm 37 which, as seen in FIG. 2, is pivoted at the opposite end at 42. Between the ends of the arm 37 is provided a cam follower or roller 38, which cooperates with the Swiss cam 41, having the rises 36 and 40. When the cam roller 38 engages the rise at 36, the arm 37 is deflected downward, thereby forcing the arm 31 down at the rear end and elevating the upper front shaft 17 and the screen and squeegee. Since the vertical links 26 and 28 connect the lower front shaft 21, it moves upwardly also. This function will be described in greater detail in connection with the description of the operation of the printer.

Figure 1:
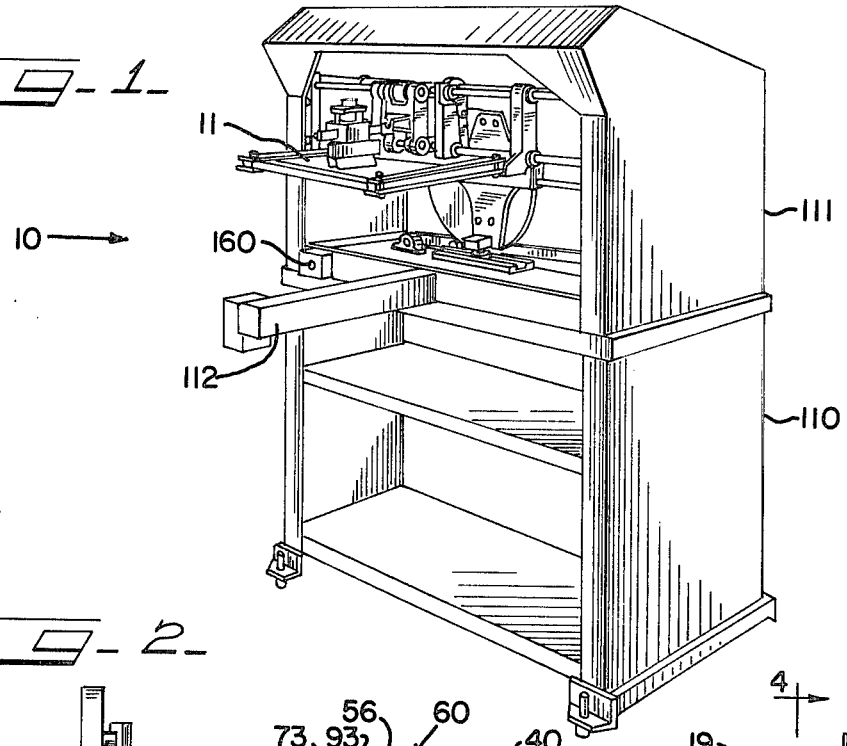
FIG. 1 is a perspective view of the improved screen printing machine of the present invention.

The elevation of the front shaft is necessary to permit the printed work to be removed and an unprinted piece registered for printing. In FIGS. 1, 2 and 4, the printing head is shown in the condition it would assume during the print cycle of the machine, with the work and jig or fixture omitted for clarity. The shafts 17 and 21 move upward and linkage rods 26 and 28 follow rollers 45 in their respective paths 47 to maintain the screen horizontal and control the path of movement of the upper shaft. By reason of the straight path 47, shaft 21 maintains the same spatial and vertical relationship to shaft 17 at all times during the printing and flood cycles. Thus, the screen assembly 11 may be lifted off the material or object being printed in a straight upward displacement, thereby maintaining the screen in a substantially horizontal position at all times in both printing and flood cycles. This constant horizontal position of the screen is important to speed, uniformity of printing and uniform distribution of ink.

Verticle linkages 25 and 27 are mounted on both of shafts 17 and 21 for sliding horizontal movement thereupon. Fixedly attached to the lower ends of the linkages 25 and 27 is a screen support bar 35, which bar carries outwardly projecting arms 36 for supporting the frame of the stencil screen. The arms 36 are provided with a suitable clamp (not shown) of known type for securing and tensioning the screen.

The squeegee assembly is supported by a vertical link 56 (FIG. 6), which link is carried on a rocker arm 73 pivotal about upper front shaft 17 and driven by first shaft 19. Thus, the squeegee assembly holding means 56 is caused to be raised simultaneously with the screen. The squeegee assembly holding means 56 is pivotally attached at its lower extremities to a support means 77 carried on lower front shaft 21, thereby forming with linkage 56, rocker arm 73 and support means 77, a parallelogramatic linkage 60 which will retain the squeegee assembly support means parallel to the screen during all cycles, both print and flood, and raise the squeegee assembly at a rate faster than the screen to assure that the squeegee is lifted off the screen in the flood cycle.

Figure 6:
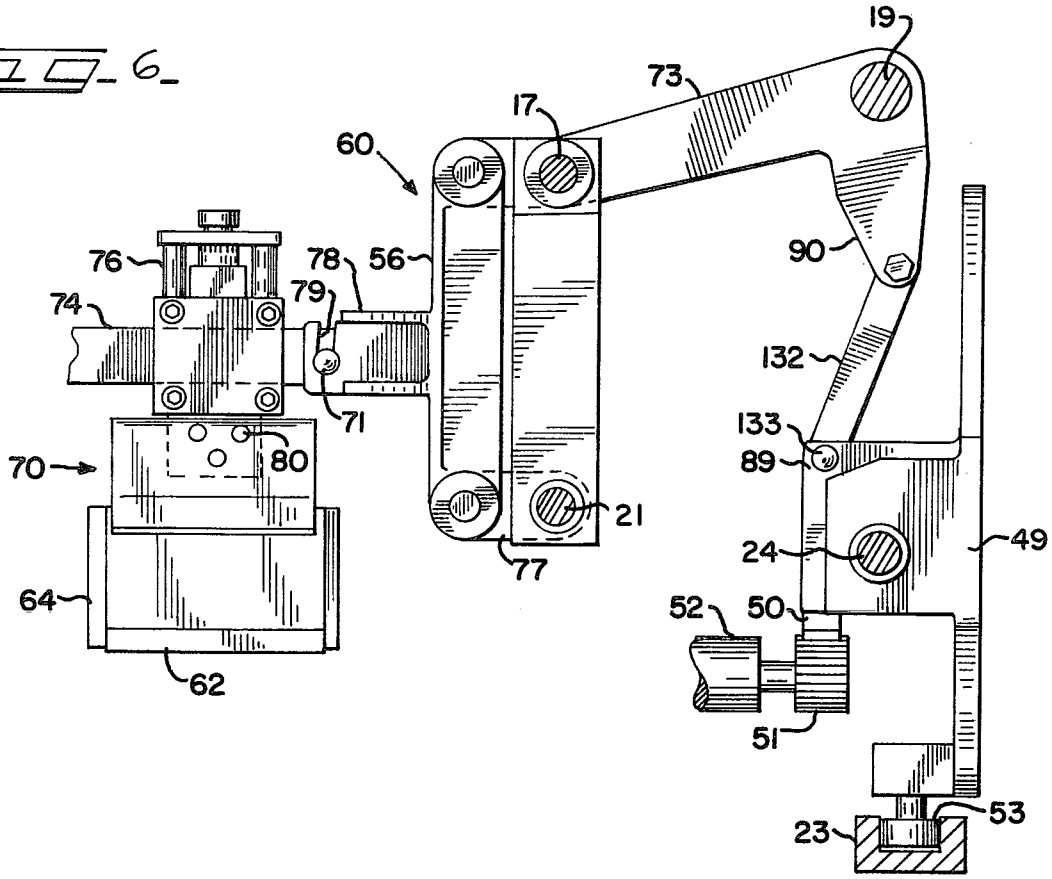
FIG. 6 is a cross-sectional view taken along the line 6—6 of FIG. 2 showing the squeegee assembly and its support means and the drive carriage.

As shown in FIGS. 2 and 6, mounted on the midsection portion of linkage 56 is a bifurcated extension 78 having a longitudinal opening 72. At the outer end of extension 78 is an upwardly extending U-shaped slot 79. Into opening 72 is inserted squeegee support 74. On squeegee support 74 is the squeegee assembly 70, supported in a cantilever manner, comprising height adjusting means 76 and squeegee blades 62 and flood bar 64. The squeegee blade 62 is adjusted to have the blade surface rest parallel to the screen surface and fastened in the position by bolt 71 and wing nut 69 within slot 79.

By rotating the micrometer adjusting means 76, the heights of the squeegee 62 and flood bar 64 relative to the screen may be set and adjusted at any time to compensate for wear of the squeegee blade, stretching of the screen, or other factors. To facilitate a change of screens, squeegee blades, etc., the squeegee assembly is easily removed from the linkage support 56 by loosening wing nut 69 and lifting the assembly 70 up and away from the extension 78. When the squeegee assembly is removed in this manner, easy access to the squeegee blades, flood bar and the screen is available. With the squeegee assembly removed, the squeegee 62 and flood bar 64 may be easily removed for replacement or sharpening by withdrawing pins 80. Similarly, the screen may be removed and replaced while the squeegee assembly is removed.

The drive arrangement for the printing press (FIG. 2) includes a variable speed motor, such as a DC motor 12, operating through the reduction gear box 130 of known type. The speed of the press may be varied by turning the knob 160 (FIG. 1), which varies the resistance in the line supplying voltage and current to the motor. The output shaft of the gear box 131 supports a Swiss cam 41, which has been previously mentioned in connection with the lifting and lowering of the screen and squeegee. The Swiss cam 41 is provided with a slot 87 to receive a cam follower 81, which is mounted on a drive carriage 49 supported on the lower rear shaft 24. As the cam rotates, the drive carriage 49 reciprocates on the shaft 24 between limits defined by the slot 87 in the Swiss cam. As seen in FIG. 6, the drive carriage is provided with a fork 89, which may be joined to a link 132 by a pin 133. The other end of the link 132 may be connected to the fork 90 on the squeegee rocker arm 73 by a pin 134 to reciprocate the squeegee if flat work is being done or the link 132 may be joined to fork 91 (FIG. 3) on the screen to reciprocate the screen when printing curvilinear or tapered work.

A rigid slot or channel 23 is formed in the mid portion of base 14. As seen in the free-body diagram of FIG. 6, the carriage 49 has a guide roller 53 traveling in track 23 for maintaining the proper relation with the shaft 24 and Swiss cam and assure smooth, reciprocating movement. On the underside of the drive carriage 49 is a rack 50, which cooperates with a pinion 51 driving an output shaft 52. The output shaft 52 may support a jig or fixture at its outer end, which receives curved objects to be rotated at the same rate as the linear rate of the screen during printing. Of course, if a rate of rotation different from the line speed of the screen is desired, different diameters may be employed to vary the rotational speed of the jig. An example of such is found in U.S. Pat. No. 3,897,725 issued Aug. 5, 1973.

The operation of the screen printing press 10 of this invention can be best described with reference to its operation during one full printing cycle. If the object to be printed is curvilinear, it is secured by appropriate means to shaft 52 for rotational movement thereabout. The drive means 12 is actuated, which rotates the Swiss cam 41, causing the roller 81 to travel in the radial slot 87, initially in a direction from left to right. The movement of the roller 81 within the vertical slideway 83 causes the carriage 49 to also move from left to right on shaft 24 in cooperation with the roller 81 and the movement of the cam 41. Prior to actuation of the drive, the link 132 is joined to the screen to permit the screen to be reciprocated and the squeegee is moved along the shafts 17 and 21 to the proper position and clamped against axial movement by a set screw 93.

After actuation, the movement of the carriage causes a cooperating movement of the screen, thereby bringing the squeegee to bear against a moving screen, distributing ink in the printing cycle. During the movement of the screen, the pinion gear 51 is turned by the movement of the rack 50, rotating the shaft 52 which, in turn, rotates the object to be printed in a precise timed relationship, thereby moving the object surface at the same rate as the screen. The size of the pinion gear, of course, is important in matching the circumferential speeds of various sizes of objects printed with the screen speed. Upon completion of the printing stroke of the squeege, the roller 38 engages the cam rise 36, depressing the lever 37 and raising shafts 17 and 21, causing the screen and squeegee assembly to be lifted off the object being printed. At this stage in the cycle, the printed object may be removed and an unprinted object placed in position for printing.

The cam 41 continues to rotate, causing the carriage 49 to return to its initial position; the corresponding movement of the screen, as it bears against the squeegee assembly and, more particularly, the flood bar, then floods the screen on the return stroke while the screen 11 is in the raised position. Upon contact with the fall 40 of the cam 41, the screen 11 is lowered and the sequeegee 62 again forces ink through upon movement of the screen.

While the foregoing description treats only the printing of curvilinear surfaces, flat objects or stock may also be printed by the subject invention with a few minor alterations. The pin holding link 132 to the screen frame is detached and connected to squeegee assembly linkage 90 by a pin 134, as shown in FIG. 6. Set screws 92, or other similar means to retain the collar of the vertical screen in a desired position on the shaft 21, are tightened, and set screw 93 on the squeegee support sleeve is loosened, to allow movement of the squeegee assembly on the screen.

Upon making these alterations, the screen printing machine of the present invention is adapted for printing on flat objects. Upon rotation of the cam 41 by drive means 12, the printing cycle begins; the carriage 49 moves in a linear fashion along shaft 24, as does the attached squeegee assembly on shaft 21. It is movement across the screen, the squeegee pushes a pool of ink before it, forcing ink through the interstices of the screen 11, printing the flat object with the desired design or message.

Upon engaging of the cam rise 36 with roller 38, the printing cycle is ended, and the return or flood cycle begins. The shafts 17 and 21, the screen 11 and squeegee assembly 70 are lifted up in a straight upward displacement by virtue of the linear path in which linkage rods are guided by rollers 45. The squeegee assembly is also lifted up in parallel movement with the screen as a result of the parallelogramatic linkage 60, which, as rocker arm 73 is pivoted about the front upper shaft 21 by the rear shaft 19 retains the squeegee assembly level on the screen during vertical movement of the screen while both the print and flood cycle are in progress.

The Swiss cam 41 continues its rotation and the carriage moves in an opposite direction, thereby returning the squeegee assembly and screen to its initial horizontal position, the flood bar 64 flooding the screen on the return stroke. Upon reaching its initial position, cam depression 40 is encountered, which brings the screen assembly down, raises the flood bar and lowers the squeegee. All is now ready for another print cycle to begin.

Upon consideration of the foregoing, it will become obvious to those skilled in the art that various modifications may be made without departing from the invention embodied herein. Therefore, only such limitations should be imposed as are indicated by the spirit and scope of the appended claims.

We claim:

1. A machine for the printing of both curvilinear and flat objects, having two spaced end supports, a first shaft pivotally mounted between said end supports, at least two spaced rocker arms mounted on said first shaft, a roller at the end of each rocker arm, vertical linkage rods having a slot at upper ends thereof, each of said rollers being captivated within one of said slots for limited movement therein, said linkage arms traveling in a vertical path formed on each of said end supports and thereby being guided for substantially vertical movement on the pivotal movement of said rocker arms, at least two shafts mounted between each vertical linkage rod in parallel at spaced points thereon for following vertical movement, said parallel shafts forming a screen support means for selective vertical or lateral movement of an associated screen assembly, a squeegee support means engages with said parallel shafts for lateral movement therealong, said first shaft having a carriage capable of reciprocal sliding movement therealong, said carriage engaging a guide means for maintaining said carriage in a constant attitude, and drive means for moving said carriage in reciprocal fashion along said first shaft, said carriage being selectively engageable to each of said screen support means and said squeegee support means for parallel reciprocal lateral movement therewith.

2. The screen printing machine of claim 1 wherein said screen support means includes a pair of laterally spaced arms, each of which joins said second and third shaft and mounting means in said arms for mounting a stencil screen frame thereon.

3. The screen printing machine of claim 1 wherein said drive means includes a means to vertically move said second shaft, thereby lifting said stencil screen and squeegee, said guide means maintaining said stencil screen in a horizontal condition throughout lifting thereof.

4. The screen printing machine of claim 1 wherein a rack gear is attached to said carriage and cooperates with a pinion gear, said pinion gear being rotated upon the reciprocatory sliding movement of said carriage for the rotation of curvilinear objects secured thereto when said screen assembly is connected to said carriage.

* * * * *